US008769968B2

(12) United States Patent
Jeong et al.

(10) Patent No.: US 8,769,968 B2
(45) Date of Patent: Jul. 8, 2014

(54) REFRIGERANT SYSTEM AND METHOD FOR CONTROLLING THE SAME

(75) Inventors: Hojong Jeong, Seoul (KR); Baikyoung Chung, Seoul (KR); Jaehwa Jung, Seoul (KR); Yongcheol Sa, Seoul (KR); Byungsoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 13/240,717

(22) Filed: Sep. 22, 2011

(65) Prior Publication Data

US 2012/0073311 A1 Mar. 29, 2012

(30) Foreign Application Priority Data

Sep. 27, 2010 (KR) ..... 10-2010-0093468

(51) Int. Cl.
*F25D 3/12* (2006.01)

(52) U.S. Cl.
USPC ..... 62/56; 62/132

(58) Field of Classification Search
USPC ..... 62/56, 77, 149, 292, 132, 324.4, 430, 62/498
See application file for complete search history.

(56) References Cited

U.S. PATENT DOCUMENTS

| | | | | |
|---|---|---|---|---|
| 3,188,829 | A * | 6/1965 | Siewert et al. | 62/160 |
| 4,646,537 | A * | 3/1987 | Crawford | 62/238.6 |
| 4,765,149 | A * | 8/1988 | Shiga et al. | 62/174 |
| 2002/0078698 | A1 | 6/2002 | Leisenheimer | |

FOREIGN PATENT DOCUMENTS

| | | | |
|---|---|---|---|
| EP | 1215452 | A1 | 11/2001 |
| JP | 2000-146322 | A | 5/2000 |
| JP | 2010-127531 | A | 6/2010 |
| KR | 10-2009-0020305 | A | 2/2009 |
| WO | 2007121540 | A2 | 11/2007 |
| WO | 2008081273 | A2 | 7/2008 |

* cited by examiner

*Primary Examiner* — Melvin Jones
(74) *Attorney, Agent, or Firm* — McKenna Long & Aldridge LLP

(57) ABSTRACT

A refrigerant system and a method for controlling the same are provided. A refrigerant system includes: an outdoor heat exchanger disposed in an operating loop of the refrigerant system and configured to perform a heat exchange between outdoor air and a refrigerant; a compressor disposed in the operating loop and configured to compress the refrigerant; an indoor heat exchanger disposed in the operating loop and configured to perform a heat exchange between indoor air and the refrigerant; an expander disposed in the operating loop and configured to expand the refrigerant; a refrigerant storage connected to the operating loop and configured to receive and store the refrigerant from and discharge the refrigerant to the operating loop; and a refrigerant storage controller configured to control a total amount of refrigerant in the operating loop based on an indoor air conditioning load and an amount of the stored refrigerant.

26 Claims, 4 Drawing Sheets

REFRIGERANT SYSTEM AND METHOD FOR CONTROLLING THE SAME

CROSS-REFERENCE TO RELATED APPLICATIONS

This application claims priority from Korean Patent Application No. 10-2010-0093468, filed on Sep. 27, 2010 in the Korean Intellectual Property Office, the entire content of which is incorporated herein by reference for all purposes as if fully set forth herein.

BACKGROUND OF THE INVENTION

1. Field of the Invention

Exemplary embodiments of the present invention relate to a refrigerant system and method for controlling the same.

2. Description of the Related Art

In the related art, there is an apparatus that cools/heats the interior of a room by performing a refrigerant cycle including compression, condensation, expansion and evaporation. The apparatus includes an indoor unit for performing a heat exchange between a refrigerant and indoor air, and an outdoor unit for performing a heat exchange between the refrigerant and outdoor air. The indoor unit includes an indoor heat exchanger for performing a heat exchange between the refrigerant and the indoor air, a fan for blowing the indoor air, and a motor for rotating the fan. The outdoor unit includes an outdoor heat exchanger for performing a heat exchange between the refrigerant and the outdoor air, a fan for blowing the outdoor air, a motor for rotating the fan, a compressor for compressing the refrigerant, an expander for expanding the refrigerant, and a four-way valve for changing the flow direction of the refrigerant.

If a cooling operation is performed in the interior of a room, the indoor heat exchanger becomes an evaporator and the outdoor heat exchanger becomes a condenser. If a heating operation is performed in the interior of the room, the indoor heat exchanger becomes a condenser and the outdoor heat exchanger becomes an evaporator. The conversion between the cooling and heating operations is performed by changing the flow direction of the refrigerant using the four-way valve.

SUMMARY OF THE INVENTION

Accordingly, the present invention is directed to a turbo fan and air conditioner that substantially obviate one or more problems due to limitations and disadvantages of the related art.

An advantage of the present invention is to enables an optimal amount of refrigerant to be flowed according to its operation state.

Another advantage of the present invention is to optimize the amount of refrigerant flowed on a refrigerant cycle according to an operation state and to enhance an entire operation efficiency of a refrigerant system.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a refrigerant system includes: an outdoor heat exchanger disposed in an operating loop of the refrigerant system and configured to perform a heat exchange between outdoor air and a refrigerant; a compressor disposed in the operating loop and configured to compress the refrigerant; an indoor heat exchanger disposed in the operating loop and configured to perform a heat exchange between indoor air and the refrigerant; an expander disposed in the operating loop and configured to expand the refrigerant; a refrigerant storage connected to the operating loop and configured to receive and store the refrigerant from and discharge the refrigerant to the operating loop; and a refrigerant storage controller configured to control a total amount of refrigerant in the operating loop based on an indoor air conditioning load and an amount of the stored refrigerant.

In another aspect of the present invention, a refrigerant system includes: an outdoor heat exchanger disposed in an operating loop of the refrigerant system and configured to perform a heat exchange between outdoor air and a refrigerant; a compressor disposed in the operating loop and configured to compress the refrigerant; an indoor heat exchanger disposed in the operating loop and configured to perform a heat exchange between indoor air and the refrigerant; an expander disposed in the operating loop and configured to expand the refrigerant; a refrigerant storage connected to the operating loop and configured to receive and store the refrigerant from and discharge the refrigerant to the operating loop; an inflow controller configured to control an amount of refrigerant received by the refrigerant storage; a discharge controller configured to control an amount of refrigerant discharged from the refrigerant storage; and a refrigerant storage controller configured to control inflow controller and the discharge controller based on an indoor air conditioning load and an amount of the stored refrigerant.

In still another aspect of the present invention, a refrigerant system includes: an outdoor heat exchanger disposed in an operating loop of the refrigerant system and configured to perform a heat exchange between outdoor air and a refrigerant; a compressor disposed in the operating loop and configured to compress the refrigerant; an indoor heat exchanger disposed in the operating loop and configured to perform a heat exchange between indoor air and the refrigerant; an expander disposed in the operating loop and configured to expand the refrigerant; a refrigerant storage connected to the operating loop and configured to receive the refrigerant from and discharge the refrigerant to the operating loop; and a refrigerant sensor configured to sense an amount of refrigerant stored in the refrigerant storage.

In still another aspect of the present invention, a method for controlling a refrigerant system includes: sensing an indoor air conditioning load and an amount of refrigerant stored in a refrigerant storage; and controlling the amount of refrigerant stored in the refrigerant storage based on the sensed indoor air conditioning load and the sensed amount of refrigerant.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENTS

Reference will now be made in detail to embodiments of the present invention, examples of which is illustrated in the accompanying drawings. Wherever possible, the same reference numbers will be used throughout the drawings to refer to the same or like parts.

Figure 1:
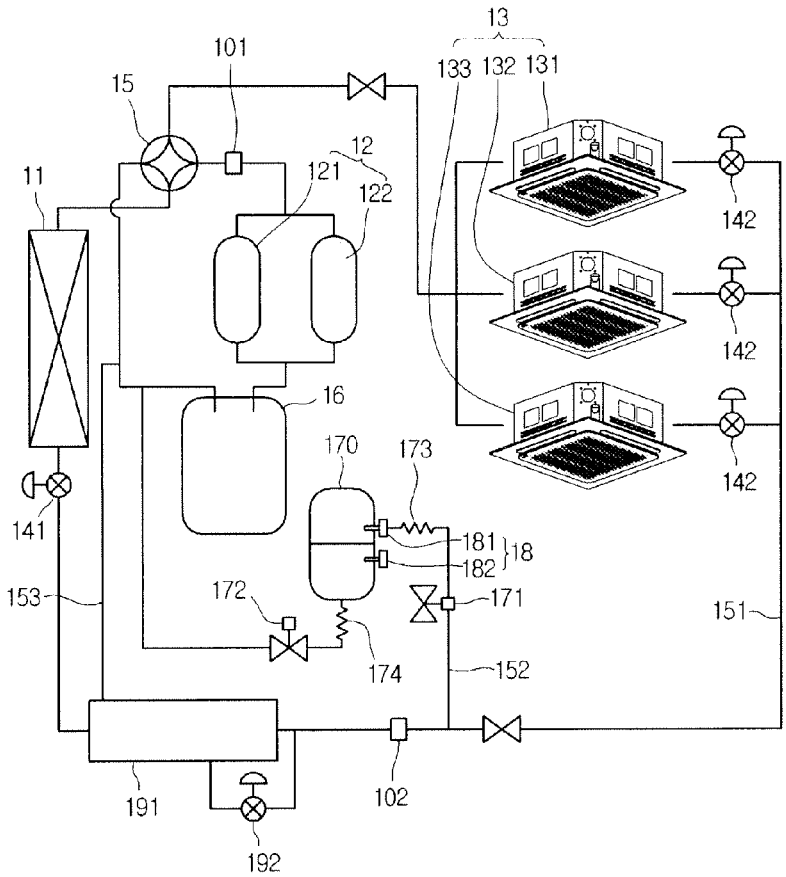
FIG. 1 is a configuration view of a refrigerant system.

FIG. 1 is a configuration view of a refrigerant system. The refrigerant system may include, for example, an outdoor heat exchanger 11, a compressor 12, an indoor heat exchanger 13, expanders 141 and 142, a main refrigerant pipe 151, an accumulator 16, and a flow switch 15. The outdoor heat exchanger 11 may perform a heat exchange between outdoor air and a refrigerant. The compressor 12 may compress the refrigerant. The indoor heat exchanger 13 may perform a heat exchange between indoor air and the refrigerant. The expanders 141 and 142 may expand the refrigerant. A main refrigerant pipe 151 may form a refrigerant cycle by connecting the outdoor heat exchanger 11, the compressor 12, the indoor heat exchanger 13 and the expanders 141 and 142, an accumulator 16 for filtering a liquefied refrigerant in the refrigerant that flows toward the compressor 12. The main refrigerant pipe may include a plurality of separate refrigerant pipes. The flow switch 15 may selectively switch the flow direction of the refrigerant discharged from the compressor 12 so that the refrigerant flows toward the outdoor heat exchanger 11 or the indoor heat exchanger 13.

Each of the outdoor heat exchanger 11 and the indoor heat exchanger 13 may serve as a condenser or evaporator according to an operation mode of the refrigerant system. For example, if the refrigerant system is in a heating operation, the outdoor heat exchanger 11 and the indoor heat exchanger 13 may serve as an evaporator and a condenser, respectively. If the refrigerant system is in a cooling operation, the outdoor heat exchanger 11 and the indoor heat exchanger 13 may serve as a condenser and an evaporator, respectively. The flow direction of the refrigerant may be switched by the flow switch 15 according to the operation mode of the refrigerant system.

In one aspect, the refrigerant system may include the compressor 12, a condenser for condensing the refrigerant that passes through the compressor 12, the expanders 141 and 142 for expanding the refrigerant that passes through the condenser, an evaporator for evaporating the refrigerant that passes through the expanders 141 and 142, the main refrigerant pipe 151 for forming the refrigerant cycle by connecting the compressor 12, the condenser, the expanders 141 and 142 and the evaporator, and the accumulator 16.

The outdoor heat exchanger 11 may be provided at one side of the outdoor space so as to be exposed to the outdoor air. The indoor heat exchanger 13 may be provided at one side of the indoor space so as to perform indoor air conditioning. The indoor heat exchanger 13 may include a plurality of indoor heat exchangers 131, 132 and 133 respectively provided in a plurality of indoor spaces.

The compressor 12 may include, for example, a constant volume compressor 121 for maintaining a compression volume constant, and an inverter compressor 122 for changing a compression volume.

The expanders 141 and 142 may include, for example, an outdoor expander 141 provided at one side of the main refrigerant pipe 151 adjacent to the outdoor heat exchanger 11, and an indoor expander 142 provided at one side of the main refrigerant pipe 151 adjacent to the indoor heat exchanger 13. The outdoor expander 141 and the indoor expander 142 may be provided at the respective sides of the main refrigerant pipe 151 for connecting the outdoor heat exchanger 11 and the indoor heat exchanger 13. The indoor expander 142 may include a plurality of indoor expanders 142 respectively provided to correspond to one sides of the plurality of indoor heat exchangers 131, 132 and 133. The indoor expander 142 may selectively block refrigerants respectively flowed into the plurality of indoor heat exchangers 131, 132 and 133 according to whether the plurality of indoor heat exchangers 131, 132 and 133 are operated.

The outdoor expander 141 and the indoor expander 142 may include valves capable of adjusting the degree of opening, such as electronic expansion valves (EEVs), so that the degree of opening may be adjusted according to the operation mode of the refrigerant system. If the refrigerant system is in heating operation, the indoor expander 142 may be completely opened and the outdoor expander 141 may be partially opened. Thus, the refrigerant that passed through the indoor heat exchanger 13 passes through the indoor expander 142 without a change in state, and may then be expanded while passing through the outdoor expander 141 and flowing into the outdoor heat exchanger 11. If the refrigerant system is in cooling operation, the outdoor expander 141 may be completely opened and the indoor expander 142 may be partially opened, so that the refrigerant that passed through the outdoor heat exchanger 11 passes through the outdoor expander 141 without a change in state, and may then be expanded while passing through the indoor expander 142 and flowing into the indoor heat exchanger 13.

The refrigerant system may further include a refrigerant storage controller 5 for controlling the amount of the refrigerant that flows on the refrigerant cycle. More specifically, the refrigerant storage controller may include a refrigerant storage 170 for storing a portion of the refrigerant that flows on the refrigerant cycle, an inflow controller 171 for controlling the amount of the refrigerant flowed into the refrigerant storage 170, a discharge controller 172 for controlling the amount of the refrigerant discharged from the refrigerant storage 170, a refrigerant sensor 18 for sensing the amount of the refrigerant stored in the refrigerant storage 170, flow rate limiters 173 and 174 for limiting the flow rate of the refrigerant that passes through the refrigerant storage 170, and a storage refrigerant pipe 152 for guiding the flow of the refrigerant between the main refrigerant pipe 151 and the refrigerant storage 170.

The refrigerant storage 170 may store a portion of the refrigerant on the refrigerant cycle so as to control the amount of the refrigerant that flows on the refrigerant cycle. The refrigerant storage 170 may include an apparatus for storing a portion of the refrigerant that flows on the refrigerant cycle, for example, such as a tank in which the refrigerant may be contained.

The inflow controller 171 may be provided at one side of the storage refrigerant pipe 152 positioned at an inflow side of the refrigerant storage 170, and the discharge controller 172 may be provided at one side of the storage refrigerant pipe 152 positioned at a discharge side of the refrigerant storage 170. Each of the inflow controller 171 and the discharge controller 172 may be configured as an apparatus capable of selectively blocking the refrigerant flowed into or discharged from the refrigerant storage 170, for example, such as an opening/closing valve.

Each of the flow rate limiters 173 and 174 may be configured as an apparatus capable of limiting the flow speed of the refrigerant flowed into or discharged from the refrigerant storage 170 to less than a predetermined speed, for example, such as a capillary tube. The flow rate limiters 173 and 174 include an inflow-side flow rate limiter 173 provided at an inflow side of the refrigerant storage 170 to limit the flow speed, i.e., flow rate of the refrigerant flowed into the refrigerant storage 170, and a discharge-side flow rate limiter 174 provided at a discharge side of the refrigerant storage 170 to limit the flow rate of the refrigerant discharged from the refrigerant storage 170.

In one embodiment the inflow controller 171, the inflow-side flow rate limiter 173, the discharge controller 172 and the discharge-side flow rate limiter 174 may be valves capable of continuously controlling the degree of opening, for example, such as EEVs, respectively.

One end of the storage refrigerant pipe 152 may be connected to one side of the main refrigerant pipe 151 that connects the outdoor heat exchanger 11 and the indoor heat exchanger 13, and the other end of the storage refrigerant pipe 152 may be connected to the other side of the main refrigerant pipe 151 corresponding to an inflow side of the accumulator 16. Therefore, a portion of the refrigerant that flows between the outdoor heat exchanger 11 and the indoor heat exchanger 13 may be flowed into the refrigerant storage 170 in the state that the inflow controller 171 is opened, and the refrigerant in the refrigerant storage 170 may be flowed into the accumulator 16 in the state that the discharge controller 172 is opened.

The refrigerant sensor 18 may be provided at one side of the refrigerant storage 170 so as to sense the amount of the refrigerant stored in the refrigerant storage 170. The refrigerant sensor 18 may include, for example, a refrigerant volume sensor or a refrigerant mass sensor.

In one embodiment, the refrigerant sensor 18 may include a plurality of level sensors 181 and 182 respectively provided at one sides with different heights so as to sense various levels of the refrigerant in the refrigerant storage 170. For example, among the plurality of level sensors 181 and 182, a first sensor 182 may be provided at the lowest position in the internal space of the refrigerant storage 170 and a second sensor 181 may be provided at the highest position in the internal space of the refrigerant storage 170. Thus, the first sensor 182 may sense whether the interior of the refrigerant storage 170 is empty, and the second sensor 181 may sense whether the interior of the refrigerant storage 170 is filled with the refrigerant. Among the plurality of level sensors 181 and 182, a third sensor (not shown) may be provided at one point between the first and second sensors 182 and 181 in the internal space of the refrigerant storage 170, so that the refrigerant storage 170 may sense whether the storage amount of the refrigerant corresponds to the standard volume of the refrigerant. The standard volume of the refrigerant may mean a fixed volume of the refrigerant stored in the refrigerant storage 170.

The refrigerant system may further include a supercooler that may supercool the refrigerant that passes through the condenser. The supercooler may include a bypass pipe 153 for bypassing a portion of the refrigerant that passes through the condenser and guiding the bypassed portion of the refrigerant to the inflow side of the accumulator 16, a supercooling heat exchanger 191 for performing a heat exchange between the bypassed portion of the refrigerant and the refrigerant in the refrigerant pipe 151, a supercooling controller 192 for controlling the amount of a portion of the refrigerant that passes through the supercooling heat exchanger 191.

Hereinafter, a control flow of the refrigerant system will be described.

Figure 2:
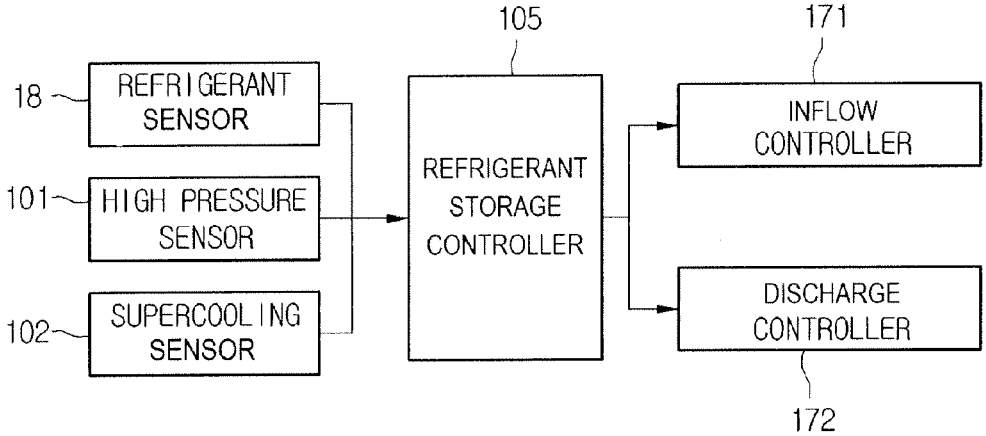
FIG. 2 is a configuration view illustrating the flow of a control signal for the refrigerant system.
Figure 3:
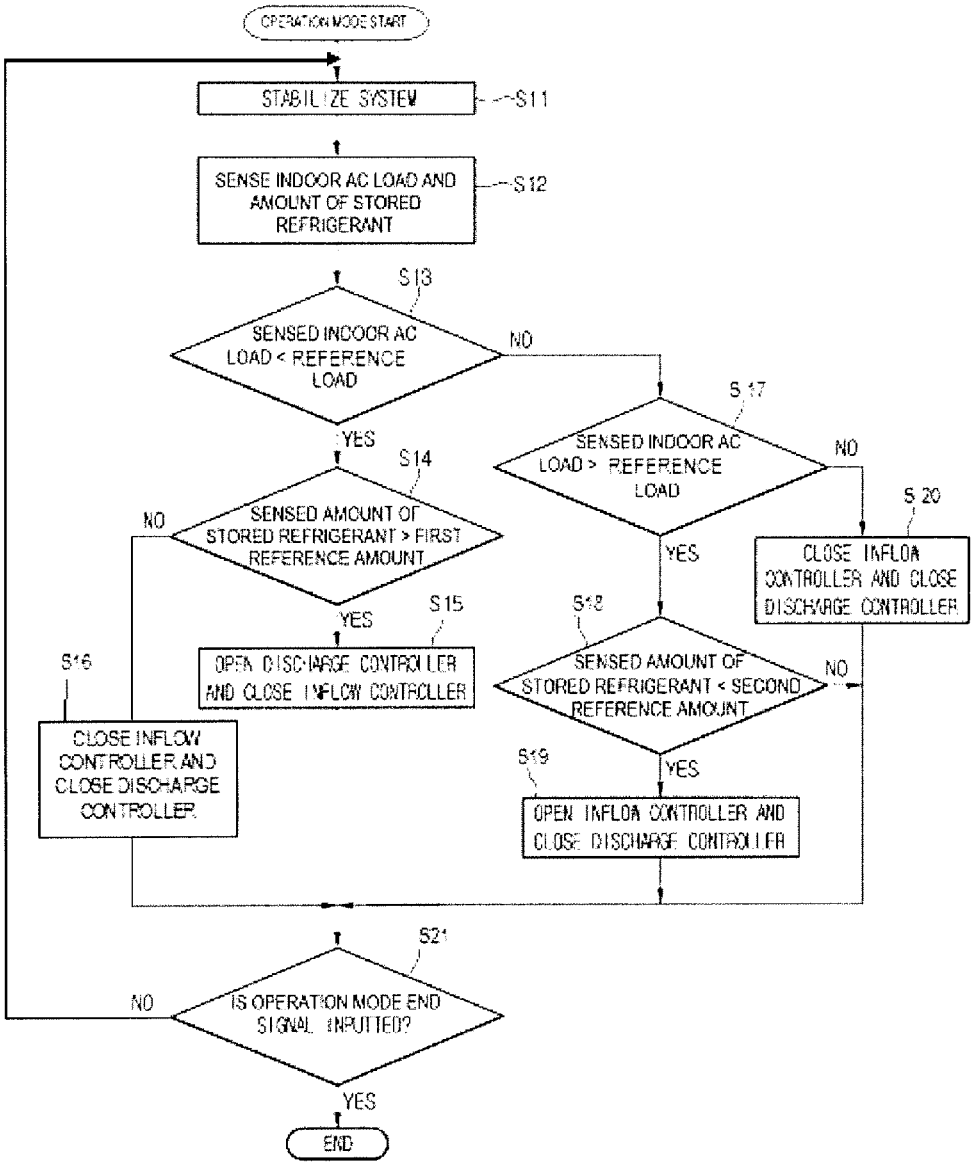
FIG. 3 is a flowchart illustrating a control flow for refrigerant system.
Figure 4:
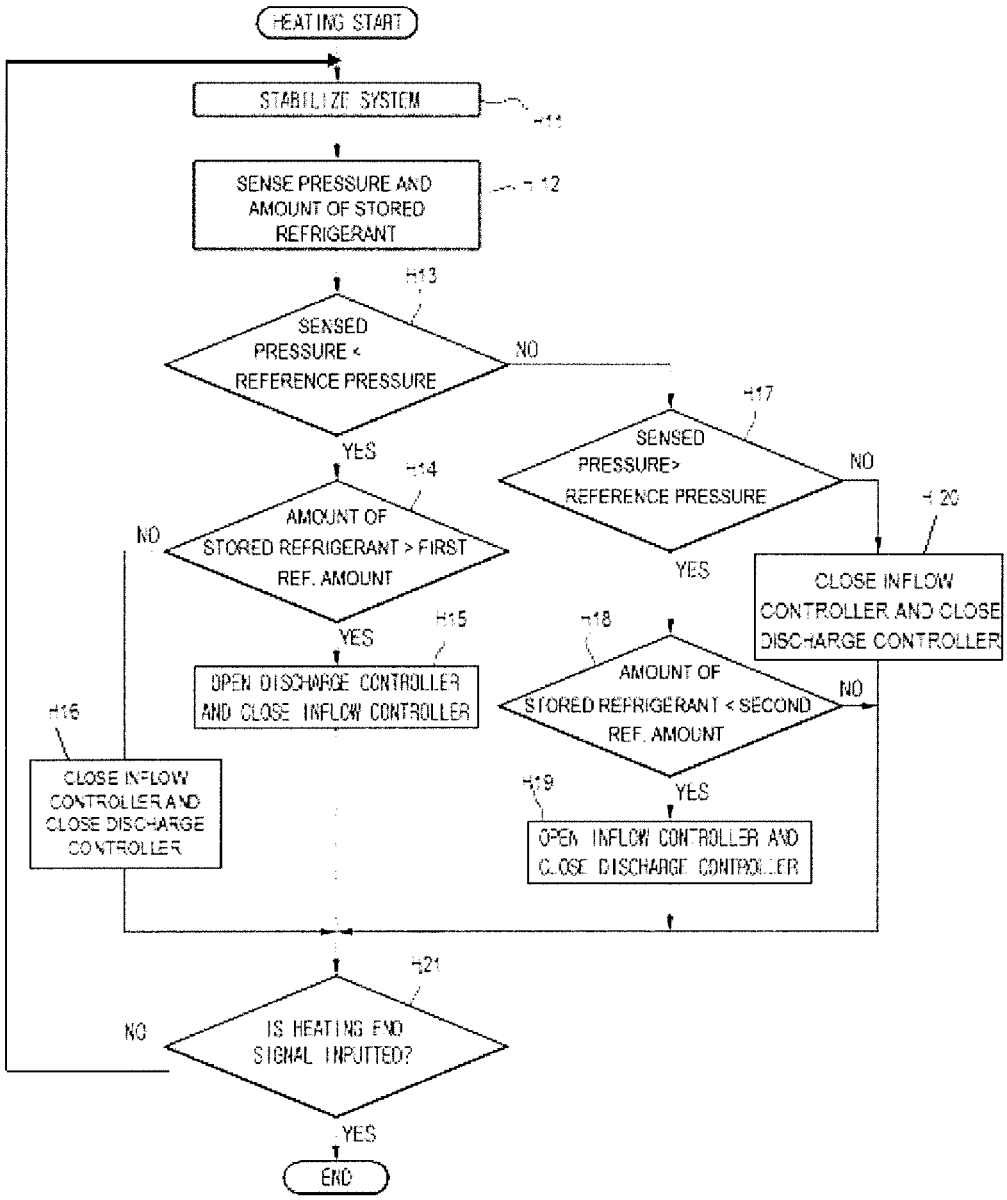
FIG. 4 is a flowchart illustrating a control flow if the refrigerant system is in a heating operation.
Figure 5:
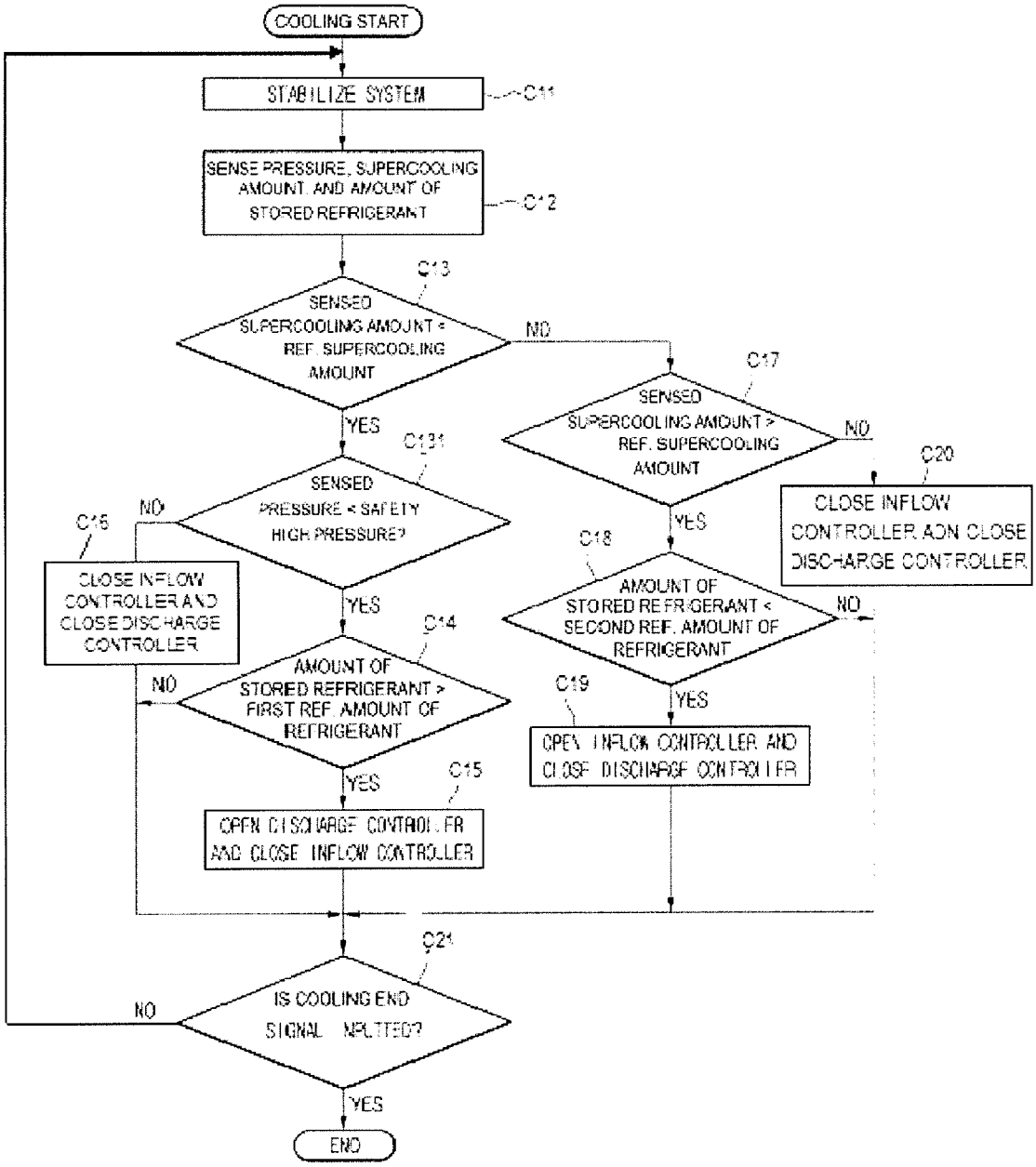
FIG. 5 is a flowchart illustrating a control flow if the refrigerant system is in a cooling operation.

FIG. 2 is a configuration view illustrating the flow of a control signal for the refrigerant system. FIG. 3 is a flowchart illustrating a control flow for refrigerant system. FIG. 4 is a flowchart illustrating a control flow if the refrigerant system is in a heating operation. FIG. 5 is a flowchart illustrating a control flow if the refrigerant system is in a cooling operation.

Referring to FIG. 2, the refrigerant system may include the refrigerant sensor 18, one or more indoor air conditioning load sensors, such as a high pressure sensor 101 and a supercooling sensor 102. The high pressure sensor 101 may be configured to sense the high pressure of the refrigerant discharged from the compressor 12, and the supercooling sensor 102 may be configured to sense a temperature, such as the supercooling degree of the refrigerant that passes the condenser. The refrigerant system may further include the inflow controller 171, the discharge controller 172, and a refrigerant storage controller 105 for controlling the inflow controller 171 and the discharge controller 172 based on information sensed from the refrigerant sensor 18, the high pressure sensor 101 and the supercooling sensor 102.

The high pressure sensor 101 may be provided at one side of the main refrigerant pipe 151, corresponding to a discharge side of the compressor 12, so that it may be easy to sense the pressure of the refrigerant at the discharge side of the compressor 12, and the supercooling sensor 102 may be provided at one side of the main refrigerant pipe 151, corresponding to a discharge side of the condenser, so that it may be easy to sense the temperature of the refrigerant that passes through the condenser. If the supercooler is provided, the supercooling sensor 102 may be provided at one side of the main refrigerant pipe 151, corresponding to a discharge side of the supercooler. The refrigerant sensor 18, the high pressure sensor 101, supercooling sensor 102, the inflow controller 171, the discharge controller 172 and the refrigerant storage controller 105 may be electrically connected to one another so as to transmit/receive a control signal.

A control flow of the refrigerant system will be described with reference to FIG. 3. If an operation mode of the refrigerant system is started, a process for entirely stabilizing the refrigerant system may be performed (S11). For example, if the operation of the refrigerant system is started, the flow state of the refrigerant may be changed, and hence time may be necessary until the operation state of the refrigerant system is stabilized. The time may elapse until the operation state of the refrigerant system is stabilized, so that the stabilization process of the refrigerant system may be performed.

Next, the indoor air conditioning load and storage amount of the refrigerant stored in the refrigerant storage 170 may be sensed (S12). The indoor air conditioning load may be sensed by an indoor air conditioning load sensor, such as a high pressure sensor 101 or a supercooling sensor 102. The storage amount of the refrigerant may be sensed by, for example, the refrigerant sensor 18.

If the indoor air conditioning load sensed by the indoor air conditioning load sensor is less than a reference indoor air conditioning load (S13) and the storage amount sensed by the refrigerant sensor 18 exceeds a first reference storage amount (S14), the discharge controller 172 may be opened and the inflow controller 171 may be closed (S15).

If the indoor air conditioning load sensed by the indoor air conditioning load sensor is less than the reference indoor air conditioning load (S13) and the storage amount sensed by the refrigerant sensor 18 is less than the first reference storage amount (S14), the discharge controller 172 may be closed and the inflow controller 171 may be closed (S16).

The reference indoor air conditioning load may mean an indoor air conditioning load necessary for achieving the desired indoor heating or cooling. The reference indoor air conditioning load may be a specific pressure value or supercooling degree value, or may be a range of a values suitable for dealing with the amount of indoor air conditioning needed. Therefore, if the sensed indoor air conditioning load is less than the reference indoor air conditioning load, it may mean that the high pressure or supercooling degree on the refrigerant cycle is deficient in dealing with the required amount of air conditioning. On the contrary, if the sensed indoor air conditioning load exceeds the reference indoor air conditioning load, it may mean that the high pressure or supercooling degree on the refrigerant cycle is excessive in dealing with the required amount indoor air conditioning. If the sensed indoor air conditioning load neither exceeds nor is less than the reference indoor air conditioning load, it may mean that the high pressure or supercooling degree on the refrigerant cycle is sufficient but not excessive in dealing with the indoor air conditioning required.

The first reference storage amount may be a minimum storage amount, which may mean a minimum value of the amount of refrigerant to be stored in the refrigerant storage 170. For example, if it is possible to achieve an empty state, i.e., no refrigerant is contained in the refrigerant storage 170, the minimum storage amount may be '0'.

Therefore, if the storage amount is less than the first reference storage amount (S14), the next operation may be performed without opening the discharge controller 172. Thus, it may be possible to prevent power waste, damage of the discharge controller 172, and the like, which may generated by opening the discharge controller 172 even though no refrigerant is discharged from the refrigerant storage 170.

If the sensed indoor air conditioning load exceeds the reference indoor air conditioning load (S17) and the storage amount is less than a second reference storage amount (S18), the inflow controller 171 may be opened and the discharge controller 172 may be closed (S19).

If the sensed indoor air conditioning load exceeds the reference indoor air conditioning load (S17) and the storage amount exceeds the second reference storage amount (S18), the inflow controller 171 may be closed and the discharge controller 172 may be closed (S20).

The second reference storage amount may be a maximum storage amount, which may mean a maximum value of the amount of refrigerant to be stored in the refrigerant storage 170. For example, if the refrigerant is fully filled in the interior space of the refrigerant storage 170, the amount of the refrigerant fully filled in the interior space of the refrigerant storage 170 may be the maximum storage value.

If the storage amount is more than the second reference storage amount (S18), the next operation may be performed without opening the inflow controller 171. Thus, it may be possible to prevent power waste, damage of the inflow controller 171, and the like, which may generated by opening the inflow controller 171 even though no refrigerant is flowed into the refrigerant storage 170.

If the sensed indoor air conditioning load is not less than the reference indoor air conditioning load (S13) and does not exceed the reference indoor air conditioning load (S17), for example the sensed indoor air conditioning load is within a range defined by the reference indoor air conditioning load, the present state may be maintained or the inflow controller and the discharge controller may be closed (S19).

As long as a signal for ending the operation mode of the refrigerant system is not inputted (S21), the stabilization process of the refrigerant system may be again performed (S11). The input of the signal for ending the operation mode of the refrigerant system may include a separate signal inputted by a user and a condition internally set to end the operation mode of the refrigerant system.

The control flow of the refrigerant system in a heating operation will be described with reference to FIG. 4. If the heating operation of the refrigerant system is started, a process for entirely stabilizing the refrigerant system may be performed (H11). For example, if the operation of the refrigerant system is started, the flow state of the refrigerant may be changed, and hence time may be necessary until the operation state of the refrigerant system is stabilized. The time may elapse until the operation state of the refrigerant system is stabilized, so that the stabilization process of the refrigerant system may be performed.

If the refrigerant system is stabilized, the high pressure and storage amount of the refrigerant stored in the refrigerant storage 170 may be sensed (H12). The high pressure and storage amount of the refrigerant may be sensed by the high pressure sensor 101 and the refrigerant sensor 18, respectively.

If the pressure sensed by the high pressure sensor 101, i.e., the sensed high pressure is less than a reference high pressure (H13) and the storage amount sensed by the refrigerant sensor 18 exceeds a first reference storage amount (H14), the discharge controller 172 may be opened and the inflow controller 171 may be closed (H15).

If the pressure sensed by the high pressure sensor 101, i.e., the sensed high pressure is less than a reference high pressure (H13) and the storage amount sensed by the refrigerant sensor 18 is less than a first reference storage amount (H14), the discharge controller 172 may be closed and the inflow controller 171 may be closed (H16).

The reference high pressure may mean a pressure value suitable for achieving the indoor heating, i.e., for dealing with an indoor air conditioning load. The reference high pressure may be a specific pressure value, or may be a range of a pressure value suitable for dealing with the indoor air conditioning load. Therefore, if the sensed pressure is less than the reference high pressure, it may mean that the pressure on the refrigerant cycle is deficient in dealing with the indoor air conditioning load. On the contrary, if the sensed high pressure exceeds the reference high pressure, it may mean that the pressure on the refrigerant cycle is excessive in dealing with the required amount of indoor air conditioning. If the sensed high pressure neither exceeds nor is less than the reference high pressure, it may mean that the high pressure on the refrigerant cycle is sufficient but not excessive in dealing with the indoor air conditioning required.

The reference storage amount may be a minimum storage amount, which may mean a minimum value of the amount of refrigerant to be stored in the refrigerant storage 170. For example, if it is possible to achieve an empty state, i.e., a state that no refrigerant is contained in the refrigerant storage 170, the minimum storage amount may be '0'.

Therefore, if the storage amount is less than the first reference storage amount (H14), the next operation may be performed without opening the discharge controller 172. Thus, it may be possible to prevent power waste, damage of the discharge controller 172, and the like, which may generated by opening the discharge controller 172 even though no refrigerant is discharged from the refrigerant storage 170.

If the sensed high pressure exceeds the reference high pressure (H17) and the storage amount is less than a second reference storage amount (H18), the inflow controller 171 may be opened and the discharge controller 172 may be closed (H19).

If the sensed high pressure exceeds the reference high pressure (H17) and the storage amount is greater than the second reference storage amount (H18), the inflow controller 171 may be closed and the discharge controller 172 may be closed (H19).

The second reference storage amount may be a maximum storage amount, which may mean a maximum value of the amount of refrigerant to be stored in the refrigerant storage 170. For example, if the refrigerant is fully filled in the interior space of the refrigerant storage 170, the amount of the refrigerant fully filled in the interior space of the refrigerant storage 170 may be the maximum storage value.

Therefore, if the storage amount is more than the maximum storage amount (H18), the next operation may be performed without opening the inflow controller 171. Thus, it may be possible to prevent power waste, damage of the inflow controller 171, and the like, which may generated by opening the inflow controller 171 even though no refrigerant is flowed into the refrigerant storage 170.

If the sensed high pressure is not less than the reference high pressure (H13) and does not exceed the reference high pressure (H17), i.e., where the sensed high pressure corresponds to the reference high pressure, the present stage may be maintained or the inflow controller and the discharge controller may be closed (H19).

As long as a signal for ending the heating operation of the refrigerant system is not inputted (H21), the stabilization process of the refrigerant system may be again performed (H11). The input of the signal for ending the heating operation of the refrigerant system may include a separate signal inputted by a user and a condition internally set to end the heating operation of the refrigerant system.

The control flow of the refrigerant system in cooling operation will be described with reference to FIG. 5. If the cooling operation of the refrigerant system is started, a process for entirely stabilizing the refrigerant system may be performed (C11).

If the refrigerant system is stabilized, the high pressure, supercooling amount (such as supercooling degree) and storage amount of the refrigerant stored in the refrigerant storage 170 (C12) may be sensed. The high pressure, supercooling degree and the storage amount of the refrigerant may be sensed by the high pressure sensor 101, the supercooling sensor 102 and the refrigerant sensor 18, respectively.

If the supercooling degree sensed by the supercooling sensor 102, i.e., the sensed supercooling degree is less than a reference supercooling degree (C13), the high pressure sensed by the high pressure sensor 101 is less than a safety high pressure (C131) and the storage amount sensed by the refrigerant sensor 18 exceeds a first reference storage amount (C14), the discharge controller 172 may be opened and the inflow controller 171 may be closed (C15).

The reference supercooling degree may mean a supercooling degree value suitable for achieving the indoor cooling, i.e., for dealing with a requirement amount of indoor air conditioning. The reference supercooling degree may be a specific supercooling degree value, or may be a range of a supercooling degree values suitable for dealing with the indoor air conditioning load. Therefore, if the sensed supercooling degree is less than the reference supercooling degree, it may mean that the supercooling degree on the refrigerant cycle is deficient in dealing with the indoor air conditioning required. On the contrary, if the sensed supercooling degree exceeds the reference supercooling degree, it may mean that the supercooling degree on the refrigerant cycle is excessive in dealing with the required amount of indoor air conditioning. If the sensed supercooling degree neither exceeds nor is less than the reference supercooling degree, it may mean that the supercooling degree on the refrigerant cycle is sufficient but not excessive in dealing with the indoor air conditioning required.

The high pressure and supercooling degree are state quantities changed according to the required amount of indoor air conditioning of the refrigerant system, and the comparison of the high pressure and supercooling degree with the reference high pressure and supercooling degree may mean the comparison of the indoor air conditioning load of the refrigerant system with a reference load.

The safety high pressure may mean a minimum high pressure value at which an overload may be applied to the compressor 12 and the refrigerant pipe. That is, if the high pressure on the refrigerant cycle is more than the safety high pressure, the pressure 12 and refrigerant pipe may be damaged.

Therefore, if the sensed high pressure is more than the safety high pressure (C131), the next operation may be performed without opening the discharge controller 172. Thus, it may be possible to prevent the damage of the compressor 12 and refrigerant pipe.

If the storage amount is less than the first reference storage amount (C14), the next operation may be performed without opening the discharge controller 172. Thus, it may be possible to prevent power waste, damage of the discharge controller 172, and the like, which may generated by opening the discharge controller 172 even though no refrigerant is discharged from the refrigerant storage 170.

If the sensed supercooling degree exceeds the reference supercooling degree (C17) and the storage amount is less than the second reference storage amount (C18), the inflow controller 171 may be opened (C19).

However, if the storage amount is more than the second reference storage amount (C18), the next operation may be performed without opening the inflow controller 171. Thus, it may be possible to prevent power waste, damage of the inflow controller 171, and the like, which may generated by opening the inflow controller 171 even though no refrigerant is flowed into the refrigerant storage 170.

If the sensed supercooling degree is not less than the reference supercooling degree (C13) and does not exceed the reference supercooling degree (C17), i.e., where the sensed supercooling degree corresponds to the reference supercooling degree, the present state may be maintained or the inflow controller and discharge controller may be closed.

As long as there is no signal input for ending the cooling operation of the refrigerant system (C21), the stabilization process of the refrigerant system may be again performed (C11). The signal input for ending the cooling operation of the refrigerant system may include a separate signal inputted by a user and a condition internally set to end the heating operation of the refrigerant system.

According to the refrigerant system, the amount of the refrigerant flowed on the refrigerant cycle may be optimally controlled according to the operation state of the refrigerant system.

More specifically, if the sensed high pressure is less than the reference high pressure in the heating operation, the discharge controller 172 may be opened, so that the refrigerant stored in the refrigerant storage 170 may be supplemented to the main refrigerant pipe 151. That is, the amount of the refrigerant flowed on the refrigerant cycle may be increased, so that the high pressure may be increased to approach the reference high pressure. If the sensed high pressure exceeds the reference high pressure, the inflow controller 171 may be opened, so that the refrigerant in the main refrigerant pipe 151 may be stored in the refrigerant storage 170. That is, the amount of the refrigerant flowed on the refrigerant cycle may be decreased, so that the high pressure may be decreased to approach the reference high pressure.

If the sensed supercooling degree is less than the reference supercooling degree in the cooling operation, the discharge controller 172 may be opened, so that the refrigerant stored in the refrigerant storage 170 may be supplemented to the main refrigerant pipe 151. That is, the amount of the refrigerant flowed on the refrigerant cycle may be increased, so that the supercooling degree may be increased to approach the reference supercooling degree. If the sensed supercooling degree exceeds the reference supercooling degree, the inflow controller 171 may be opened, so that the refrigerant in the main refrigerant pipe 151 may be stored in the refrigerant storage 170. That is, the amount of the refrigerant flowed on the refrigerant cycle may be decreased, so that the supercooling degree may be decreased to approach the reference supercooling degree.

According to the refrigerant system, the entire operation efficiency of the refrigerant system may be enhanced. More specifically, the performance of the refrigerant system for dealing with the required amount of indoor air conditioning may be varied by only a change in amount of the refrigerant flowed on the refrigerant cycle, e.g., a running rate of the compressor 12, without a change in rotation speed of a fan (not shown), or the like. Thus, the entire operation efficiency of the refrigerant system may be enhanced.

According to the refrigerant system, the operation efficiency may be optimized within a range and damage to the refrigerant system may be prevented. More specifically, although the sensed supercooling degree is less than the reference supercooling degree in the cooling operation, the next operation may be performed without opening the discharge controller 172 if the sensed high pressure is more than the safety high pressure. That is, it may be possible to prevent the damage of the compressor 12 and refrigerant pipe, generated by increasing the amount of the refrigerant flowed on the refrigerant cycle and increasing the high pressure together according to the opening of the discharge controller 172.

It will be apparent to those skilled in the art that various modifications and variation may be made in the present invention without departing from the spirit or scope of the invention. Thus, it is intended that the present invention cover the modifications and variations of this invention provided they come within the scope of the appended claims and their equivalents.

What is claimed is:

1. A refrigerant system, comprising:

an outdoor heat exchanger disposed in an operating loop of the refrigerant system and configured to perform a heat exchange between outdoor air and a refrigerant;

a compressor disposed in the operating loop and configured to compress the refrigerant;

an indoor heat exchanger disposed in the operating loop and configured to perform a heat exchange between indoor air and the refrigerant;

an expander disposed in the operating loop and configured to expand the refrigerant;

a refrigerant storage connected to the operating loop and configured to receive and store the refrigerant from and discharge the refrigerant to the operating loop; and a refrigerant storage controller configured to control a total amount of refrigerant in the operating loop based on an indoor air conditioning load and an amount of the stored refrigerant, and wherein if the indoor air conditioning load is less than a reference load and if the amount of the stored refrigerant is greater than a first reference amount, then the refrigerant storage controller controls the total amount of refrigerant in the operating loop to be increased.

2. The refrigerant system of claim 1, wherein if the indoor air conditioning load is less than a reference load and if the amount of the stored refrigerant is less than a first reference amount, then the refrigerant storage controller controls the total amount of refrigerant in the operating loop to be maintained.

3. The refrigerant system of claim 1, wherein if the indoor air conditioning load is greater than a reference load and if the amount of the stored refrigerant is less than a second reference amount, then the refrigerant storage controller controls the total amount of refrigerant in the operating loop to be decreased.

4. The refrigerant system of claim 1, wherein if the indoor air conditioning load is greater than a reference load and if the amount of the stored refrigerant is greater than a second reference amount, then the refrigerant storage controller controls the total amount of refrigerant in the operating loop to be maintained.

5. The refrigerant system of claim 1, wherein if the indoor air conditioning load is neither less than nor greater than a second reference load, then the refrigerant storage controller controls the total amount of refrigerant in the operating loop to be maintained.

6. A refrigerant system, comprising:

an outdoor heat exchanger disposed in an operating loop of the refrigerant system and configured to perform a heat exchange between outdoor air and a refrigerant;

a compressor disposed in the operating loop and configured to compress the refrigerant;

an indoor heat exchanger disposed in the operating loop and configured to perform a heat exchange between indoor air and the refrigerant;

an expander disposed in the operating loop and configured to expand the refrigerant;

a refrigerant storage connected to the operating loop and configured to receive and store the refrigerant from and discharge the refrigerant to the operating loop;

an inflow controller configured to control an amount of refrigerant received by the refrigerant storage;

a discharge controller configured to control an amount of refrigerant discharged from the refrigerant storage; and a refrigerant storage controller configured to control inflow controller and the discharge controller based on an indoor air conditioning load and an amount of the stored refrigerant, and wherein if the indoor air conditioning load is less than a reference load and if the amount of the stored refrigerant is greater than a first reference amount, then the refrigerant storage controller controls the discharge controller to be opened and controls the inflow controller to be closed.

7. The refrigerant system of claim 6, wherein if the indoor air conditioning load is less than a reference load and if the amount of the stored refrigerant is less than a first reference amount, then the refrigerant storage controller controls the discharge controller and the inflow controller to be closed.

8. The refrigerant system of claim 6, wherein if the indoor air conditioning load is greater than a reference load and if the amount of the stored refrigerant is less than a second reference amount, then the refrigerant storage controller controls the discharge controller to be closed and the inflow controller to be opened.

9. The refrigerant system of claim 6, wherein if the indoor air conditioning load is greater than a reference load and if the amount of the stored refrigerant is greater than a second reference amount, then the refrigerant storage controller controls the discharge controller and the inflow controller to be closed.

10. The refrigerant system of claim 6, wherein if the indoor air conditioning load is neither less than nor greater than a reference load, then the refrigerant storage controller controls the discharge controller and the inflow controller to be closed.

11. A refrigerant system comprising:

an outdoor heat exchanger disposed in an operating loop of the refrigerant system and configured to perform a heat exchange between outdoor air and a refrigerant;

a compressor disposed in the operating loop and configured to compress the refrigerant;

an indoor heat exchanger disposed in the operating loop and configured to perform a heat exchange between indoor air and the refrigerant;

an expander disposed in the operating loop and configured to expand the refrigerant;

a refrigerant storage connected to the operating loop and configured to receive the refrigerant from and discharge the refrigerant to the operating loop;

a refrigerant sensor configured to sense an amount of refrigerant stored in the refrigerant storage; and a supercooling sensor configured to sense a supercooling amount of the refrigerant flowing from the outdoor heat exchanger, and wherein if the supercooling amount sensed by the supercooling sensor is less than a reference supercooling amount and if the amount of refrigerant sensed by the refrigerant sensor is greater than a first reference amount, then a total amount of refrigerant in the operating loop is increased.

12. The refrigerant system of claim 11, further comprising a high pressure sensor configure to sense a pressure of the refrigerant flowing from a discharge side of the compressor.

13. The refrigerant system of claim 12, wherein if the pressure sensed by the high pressure sensor is less than a reference pressure and if the amount of refrigerant sensed by the refrigerant sensor is greater than a first reference amount, then a total amount of refrigerant in the operating loop is increased.

14. The refrigerant system of claim 12, wherein if the pressure sensed by the high pressure sensor is less than a reference pressure and if the amount of refrigerant sensed by the refrigerant sensor is less than a first reference amount, then a total amount of refrigerant in the operating loop is maintained.

15. The refrigerant system of claim 12, wherein if the pressure sensed by the high pressure sensor is greater than a reference pressure and if the amount of refrigerant sensed by the refrigerant sensor is less than a second reference amount, then a total amount of refrigerant in the operating loop is decreased.

16. The refrigerant system of claim 12, wherein if the pressure sensed by the high pressure sensor is greater than a reference pressure and if the amount of refrigerant sensed by the refrigerant sensor is greater than a second reference amount, then a total amount of refrigerant in the operating loop is maintained.

17. The refrigerant system of claim 12, wherein if the pressure sensed by the high pressure sensor is neither less than nor greater than a reference pressure, then a total amount of refrigerant in the operating loop is maintained.

18. The refrigerant system of claim 11, wherein if the supercooling amount sensed by the supercooling sensor is less than a reference supercooling amount and if the amount of refrigerant sensed by the refrigerant sensor is less than a first reference amount, then a total amount of refrigerant in the operating loop is maintained.

19. The refrigerant system of claim 11, wherein if the supercooling amount sensed by the supercooling sensor is greater than a reference supercooling amount and if the amount of refrigerant sensed by the refrigerant sensor is less than a second reference amount, then a total amount of refrigerant in the operating loop is decreased.

20. The refrigerant system of claim 11, wherein if the supercooling amount sensed by the supercooling sensor is greater than a reference supercooling amount and if the amount of refrigerant sensed by the refrigerant sensor is greater than a second reference amount, then a total amount of refrigerant in the operating loop is maintained.

21. The refrigerant system of claim 11, wherein if the supercooling amount sensed by the supercooling sensor is neither less than nor greater than the reference supercooling amount, then a total amount of refrigerant in the operating loop is maintained.

22. The refrigerant system of claim 11, further comprising a high pressure sensor configure to sense a pressure of the refrigerant flowing from a discharge side of the compressor, wherein if the supercooling amount sensed by the supercooling sensor is less than a reference supercooling amount, if the sensed pressure is less than a safety pressure and if the amount of refrigerant sensed by the refrigerant sensor is greater than a first reference amount, then a total amount of refrigerant in the operating loop is increased.

23. The refrigerant system of claim 22, wherein if the supercooling amount sensed by the supercooling sensor is less than the reference supercooling amount and if the sensed pressure is greater than a safety pressure, the total amount of refrigerant in the operating loop is maintained.

24. The refrigerant system of claim 12, wherein the refrigerant sensor includes a plurality of level sensors to sense a plurality of levels of the refrigerant stored in the refrigerant storage.

25. The refrigerant system of claim 24, wherein a first of the plurality of sensors is provided at a low position in an internal space of the refrigerant storage and a second the plurality of sensors is provided at a high position in the internal space of the refrigerant storage.

26. The refrigerant system of claim 25, wherein a third of the plurality of sensors is provided in the internal space of the refrigerant storage at a position between the low position of the first sensor and the high position of the second sensor.

* * * * *